United States Patent [19]

Nixon et al.

[11] Patent Number: 4,746,006

[45] Date of Patent: May 24, 1988

[54] FILTER CIGARETTE MANUFACTURE

[75] Inventors: John E. Nixon; Robert E. Williams, both of High Wycombe, England

[73] Assignee: Molins Machine Co, Inc., Bucks, England

[21] Appl. No.: 864,134

[22] Filed: May 16, 1986

[30] Foreign Application Priority Data

May 17, 1985 [GB] United Kingdom ..... 8512559

[51] Int. Cl.[4] ..... B65G 47/24

[52] U.S. Cl. ..... 198/458; 198/410; 131/282

[58] Field of Search ..... 198/441, 448, 450, 458, 198/951, 471.1, 803.5, 449, 410; 131/282, 283, 27 R, 28

[56] References Cited

U.S. PATENT DOCUMENTS

| | | | |
|---|---|---|---|
| 3,199,418 | 8/1965 | Schubert | 198/458 X |
| 3,372,702 | 3/1968 | Bohn et al. | 198/458 X |
| 3,973,671 | 8/1976 | Schwenke | 198/951 X |
| 4,167,995 | 9/1979 | Schumacher | 198/458 |
| 4,200,179 | 4/1980 | Hinz | 198/458 |
| 4,438,774 | 3/1984 | Dyett et al. | 131/283 X |
| 4,531,629 | 7/1985 | Seragnoli et al. | 198/458 |
| 4,664,249 | 5/1987 | Gherardi | 198/458 X |

FOREIGN PATENT DOCUMENTS

| | | | |
|---|---|---|---|
| 1532163 | 2/1973 | Fed. Rep. of Germany | 198/410 |

*Primary Examiner*—Robert J. Spar
*Assistant Examiner*—Lyle K. Kimms
*Attorney, Agent, or Firm*—Antonelli, Terry, & Wands

[57] ABSTRACT

Apparatus for separating axially-aligned rods of the cigarette industry comprises a first pair of conical drums (14,16) mounted on a first common sleeve (32) and arranged to receive respectively the two rods (10) of each pair to be separated, the axes of rotation (22, 24) of the drums being inclined so as to separate the rods carried by the respective drums; a second pair of conical drums (25,26) mounted on a second common sleeve and arranged to receive the cigarettes from the first pair of conical drums, the second pair of conical drums having axes inclined so as to space the rods further apart while returning the rods to axially-aligned orientations; and device (28) for receiving the spaced-apart rods from the second pair of conical drums.

10 Claims, 2 Drawing Sheets

FILTER CIGARETTE MANUFACTURE

During the manufacture of filter cigarettes, there is at least one stage during which rods, usually double-length cigarettes, need to be cut in half and then separated while being conveyed sideways by a fluted drum. Fixed ploughs have commonly been used, but they tend to damage the ends of the rods which necessarily rub against the ploughs. More complicated mechanisms have been devised which avoid or minimise damage to the rods but which lack reliability in view of their complication; moreover, if the separation distance needs to be changed (which is not uncommon during the lifetime of a machine) that adds to the complications.

The present invention is concerned with the use of conical drums for separating the halves of cut rods. The use of conical drums was disclosed in U.S. Pat. No. 3,372,702, but the arrangement described therein is impractical, particularly since it does not lend itself readily to adjustment of the separation distance.

According to one aspect of this invention, apparatus for separating axially-aligned rods of the cigarette industry carried by a fluted drum comprises a first pair of conical drums mounted on a first common sleeve and arranged to receive respectively the two rods of each pair to be separated, the axes of rotation of the drums being inclined so as to separate the rods carried by the respective drums; a second pair of conical drums mounted on a second common sleeve and arranged to receive the cigarettes from the first pair of conical drums, the second pair of conical drums having axes inclined so as to space the rods further apart while returning the rods to axially-alligned orientations; and means for receiving the spaced-apart rods from the second pair of conical drums.

The arrangement is preferably such that each sleeve, independently of the other sleeve, can be slid axially off corresponding support member to allow replacement of the conical drums with different drums adapted for different separation distances, the drums being removable from the sleeve by sliding off opposite ends of the sleeve. The support member is preferably a stationary tubular member, the conical drums being driven by a shaft extending through the support member and coupled to an outer one of the conical drums, preferably via a bevel gear; the inner conical drum is preferably driven via the outer drum by bevel gears.

Figure 1:
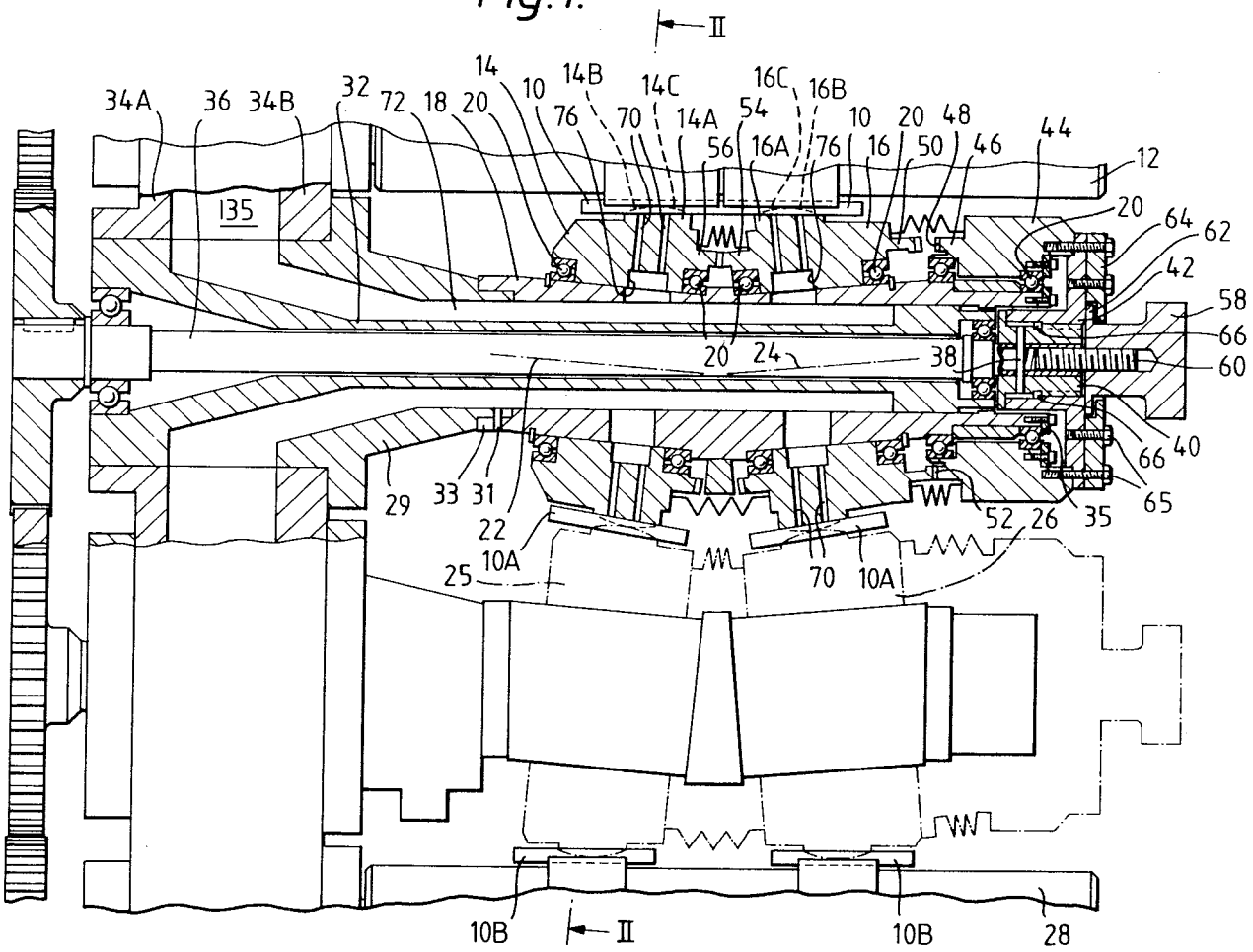
Figure 2:
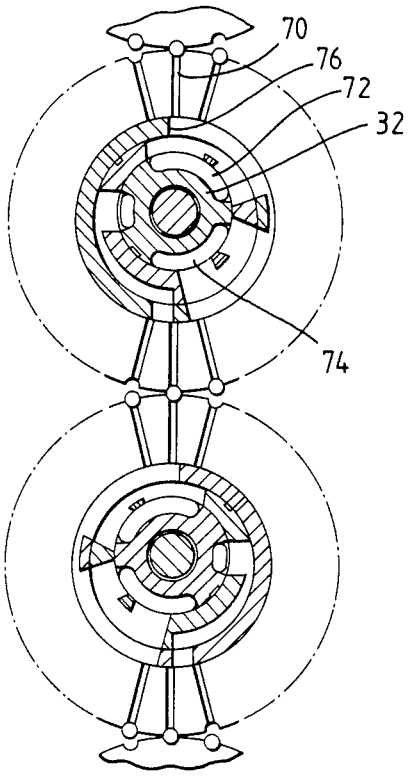

An example of a rod separation apparatus according to this invention is shown in the accompanying drawings. In these drawings:

FIG. 1 is a section through part of the apparatus taken in a plane containing the axes of rotation of the conical drums; and FIG. 2 is a section of the line II—II in FIG. 1.

As shown particularly in FIG. 1, axially aligned pairs of rods 10 are delivered by a drum 12 to a pair of conical drums 14, 16 which are carried by a common sleeve 18, being supported on the sleeve via ball or roller bearings 20 so as to be free to rotate on the sleeve.

The conical drums 14 and 16 have axes of rotation 22 and 24 respectively which are inclined so that, after 180 degrees of rotation of the conical drums, the axes of the rods (identified at this point by the reference numerals 10A) are inclined and lie in the plane of the drawing. At this stage the rods 10A are transferred to a pair of complementary conical drums 25 and 26 which continue the separation of the rods and restore the rods to axially aligned orientations as shown by the reference numerals 10B at the bottom of FIG. 1. The separated rods are then received by a further fluted drum 28.

The drums 25 and 26 are carried by a sleeve which is similar to the sleeve 18. Their general construction and method of driving are similar to those for the drums 14 and 16 and will not be specifically described. However, it is important to note that each sleeve with its surrounding conical drums can, independently of the other sleeve, be slid axially to the right. Thus each pair of drums can be removed conveniently by an operator when the drums need to be inspected or worked on, or need to be changed to produce a different separation distance.

The common sleeve 18 for the drums 14,16 is carried by a tubular support member 32 which is mounted in cantilever fashion from a machine frame comprising spaced walls 34A,34B defining a manifold 135 through which suction is transmitted for holding the rods on the drums. The general arrangement in this respect is similar to that described in our British patent specification No. 2090572.

A drive shaft 36 for the drums 14,16 extends through the middle of the support member 32 and is coupled at its outer (right-hand) end tot the outer conical drum 16 (i.e. that furthest from the frame 34A, 34B) via a pin 38 and annular parts 40, 42 and 44. The part 44 carries a gear member 46 having gear teeth 48 which mesh with a bevel gear 50 as shown at 52. The bevel gear 50 is carried by (or integral with) the conical drum 16 which in turn drives the conical drum 14 via bevel gear members 54 and 56.

Removal of the conical drums 14 and 16 is accomplished by rotating a retaining member 58 which has secured in it an externally threaded insert 60 which screws into an end bore in the shaft 36. Rotation of the member 58 in an anti-clockwise direction to screw it away from the shaft 36 also pulls towards the operator the annular part 42 (a flange 62 on the member 58 being trapped between the part 42 and an outer ring member 64 secured by bolts 65) and with it comes the sleeve 18 together with the conical drums; for the latter purpose the sleeve 18 has a bolted-on end flange 35 which is engaged and displaced via the adjacent bearing 20. After the retaining member 58 has been rotated sufficiently to disengage the insert 60 from the shaft 36, the entire assembly consisting of the sleeve and drums can be pulled off. When this assembly is returned, a rotary drive between the member 40 and the member 42 is re-established by a pair of keys 66; the angular position of the sleeve 18 relative to the fixed member 29 is set by a pin 31 which engages in an end groove 33 in the sleeve.

It should be noted that fluted portions 14A and 16A of the conical drums which carry the cigarettes have axial dimensions significantly less than the length of the rods. This facilitates the smooth transfer of rods, especially between successive conical drums, having regard to the fact that the flutes to and from which the rods pass are exactly parallel only at the actual point of transfer.

It should also be noted that the portions 14A and 16A of the conical drums have chamfered outer surfaces 14B,14C,16B,16C at both ends. These further improve the transfer conditions between the conical drums; moreover, these chamfers allow one pair of conical drums to be slid axially with respect to the other pair without interference.

Suction for holding the rods on the drums is transmitted to radial passages 70 in the drums via longitudinal passages 72 and 74 in the tubular member 32, (see also FIG. 2) and an arcuate slot 76 in the sleeve 18 defining the arc of rotation during which suction is transmitted to the radial passages.

If an increased or reduced separation distance is required, the two pairs of conical drums are replaced by appropriately modified pairs of drums having different angles of inclination between their axes 22, 24 and the axis of the sleeve 18 and shaft 36.

It is not necessary for both rods 10 to be displaced by equal distances from the central plane; instead, if necessary, the angles of inclination of the axes 22 and 24 with respect to the axis of the drive shaft 36 may be different, the other pair of conical drums differing of course in the same way.

We claim:

1. Apparatus for separating axially-aligned rods of the cigarette industry comprising a first pair of conical drums rotatably mounted on a non-rotatable first common sleeve and arranged to receive respectively the two rods of each pair to be separated, the axes of rotation of the drums being inclined so as to separate the rods carried by the respective drums; a second pair of conical drums rotatably mounted on a non-rotatable second common sleeve and arranged to receive the cigarettes from the first pair of conical drums, the second pair of conical drums having axes inclined so as to space the rods further apart while returning the rods to axially-aligned orientations; and means for receiving the spaced apart rods from the second pair of conical drums, in which each sleeve is slideably mounted on a support member so that each sleeve, independently of the other sleeve, can be slid axially off the corresponding support member, after which the drums are removable by sliding off opposite ends of the sleeve.

2. Apparatus according to claim 1 in which each support member is mounted in cantilever fashion on a frame.

3. Apparatus according to claim 2 in which each support member is a stationary tubular member, and including a drive shaft which extends though the support member and is coupled at its other end to the conical drum furthest from the frame.

4. Apparatus according to claim 3 in which the second drum is driven by the said furthest drum.

5. Apparatus according to claim 4 in which the second drum is driven by the said furthest drum via bevel gears meshing with one another where the drums are closest together.

6. Apparatus according to claim 5 in which the said furthest drum is driven by the drive shaft via a bevel gear.

7. Apparatus according to claim 1 in which the support member is formed with a passage for transmitting suction to radial passages in the conical drums for holding the rods on the drums.

8. Apparatus according to claim 3 in which each pair of conical drums is retained on the corresponding support member by a retaining member which is in screw-threaded engagement with the outer end of the drive draft.

9. Apparatus for separating axially-aligned rods of the cigarette industry comprising a first pair of conical drums rotatably mounted on a non-rotatable first common sleeve and arranged to receive respectively the two rods of each pair to be separated, the axes of rotation of the drums being inclined so as to separate the rods carried by the respective drums; a second pair of conical drums rotatably mounted on a non-rotatable second common sleeve and arranged to receive the cigarettes from the first pair of conical drums, the second pair of conical drums having axes inclined so as to space the rods further apart while returning the rods to axially-aligned orientations; and means for receiving the spaced-apart rods from the second pair of conical drums; the conical drums each having chamfered portions at least at the end of each drum which, during part of the rotation thereof, is furthest from the central axis of the corresponding sleeve, in which each sleeve is slideably mounted on a support member so that each sleeve, independently of the other sleeve, can be slid axially off the corresponding support member, after which the drums are removable by sliding off opposite ends of the sleeve.

10. Apparatus according to claim 9 in which each support member is a stationary tubular member, and including a drive shaft which extends through the support member and is coupled at its other end to the conical drum furthest from the frame.

* * * * *